US006590539B2

(12) United States Patent
shinichi

(10) Patent No.: US 6,590,539 B2
(45) Date of Patent: Jul. 8, 2003

(54) ANTENNA DEVICE IN RADIO COMMUNICATION TERMINAL

(75) Inventor: Haruyama shinichi, Tsurumi-Ku (JP)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 10/040,030

(22) Filed: Nov. 7, 2001

(65) Prior Publication Data

US 2002/0060645 A1 May 23, 2002

(30) Foreign Application Priority Data

Nov. 13, 2000 (JP) ..... 2000-345449

(51) Int. Cl.[7] ..... H01Q 1/24
(52) U.S. Cl. ..... 343/702; 343/795; 343/893
(58) Field of Search ..... 343/700 MS, 702, 343/793, 795, 893

(56) References Cited

U.S. PATENT DOCUMENTS 5,754,145 A * 5/1998 Evans ..... 343/727
6,054,954 A * 4/2000 Eggleston et al. ... 343/700 MS
6,198,943 B1 * 3/2001 Sadler et al. ..... 343/702
6,271,796 B1 * 8/2001 Itoh et al. ..... 343/702
6,326,927 B1 * 12/2001 Johnson et al. ..... 343/700 MS
6,337,666 B1 * 1/2002 Bishop ..... 343/700 MS

* cited by examiner

*Primary Examiner*—Don Wong
*Assistant Examiner*—Shih-Chao Chen
(74) *Attorney, Agent, or Firm*—Dilworth & Barrese, LLP

(57) ABSTRACT

Disclosed is a radio communication terminal having an antenna device, which is capable of feeding power to an internal antenna using a simple configuration while achieving a reduction in SAR, by using a dipole antenna as the internal antenna. In the antenna device, a power feeding circuit and a primary radiation element are mounted to a printed circuit board (PCB). Transmission power from a transmitting/receiving circuit is fed to the primary radiation element via a coaxial cable by the power feeding circuit. The dipole antenna is attached to an inner surface, outer surface, or recessed portion of the case of the terminal in such a fashion that it faces the primary radiation element while being spaced apart from the primary radiation element. A speaker is attached to a surface of the PCB opposite to the PCB surface to which the primary radiation element is mounted. Although the primary radiation element and the dipole antenna are mechanically spaced apart from each other, they are capacitance-coupled or magnetically coupled together, thus eliminating the need for a power feeding line. The PCB serves to shield electromagnetic waves radiated from the antenna device toward the head of the user.

6 Claims, 2 Drawing Sheets

ANTENNA DEVICE IN RADIO COMMUNICATION TERMINAL

This application claims priority to an application entitled "Antenna Device in Radio Communication Terminal", filed in the Japanese Patent Office on Nov. 13, 2000 and assigned Serial No. 2000-345449, the contents of which are hereby incorporated by reference.

BACKGROUND OF THE INVENTION

1. Field of the Invention

The present invention relates to an antenna device in a radio communication terminal such as a portable telephone, personal handyphone system (PHS) or personal digital assistant (PDA), and more particularly to an antenna device having a simple power feeding configuration while being capable of achieving a reduction in specific absorption rate (SAR).

2. Description of the Related Art

As the use of portable communication terminals has increased, much attention has been paid to the effects (SAR) on the human body, in particular, the head, when it is exposed to electromagnetic waves radiated from portable communication terminals. In such a portable communication terminal, current concentrates on the antenna of the terminal. As a result, electromagnetic fields are concentrated about the head of the user to which a radiation source, for example, the feeding point of the antenna, is closely positioned. This results in an increase in SAR.

Antennas for portable telephones, such as an extendable monopole antenna or a fixed helical antenna, are known in the art and externally protrude from the case of the portable phone. However, such a monopole type antenna has drawbacks in that it has a poor design and is inconvenient to use. Furthermore, the monopole type antenna cannot effectively compensate for the problems of SAR. For this reason, an internal antenna, which is internally mounted in a phone body, has been preferably used.

As an example of such an internal antenna, antenna systems for portable telephones have been proposed. As shown in FIG. 2, this conventional antenna system uses a dipole antenna (balanced feeding type antenna), and an electromagnetic shield plate in order to achieve a reduction in SAR. Now, the conventional antenna system will be described in more detail with reference to FIGS. 2*a* and 2*b*.

Referring to FIGS. 2*a* and 2*b*, a printed circuit board (PCB) 1 mounted to a phone body is illustrated. As shown in FIGS. 2*a* and 2*b*, a dipole antenna 2 is attached to an upper portion of the PCB 1 and connected to the PCB 1 via a power feeding circuit 3. A transmitting/receiving circuit 4 is arranged at a lower portion of the PCB 1. The power feeding circuit 3 and transmitting/receiving circuit 4 are connected together via a coaxial cable (semirigid cable) 5. A speaker is mounted to a surface of the PCB 1 opposite to the PCB surface to which the dipole antenna 2 is attached.

The operation of the antenna system having the above mentioned configuration will now be described. Transmission power from the transmitting/receiving circuit 4 is fed to the power feeding circuit 3 via the coaxial cable 5. Thereafter, the transmission mode of the transmission power is passed to an unbalance/balance-transformer (a balun). In this state, the transmission power is fed to the dipole antenna 2. For simplicity, the balun is not shown in the Figures.

When the user uses the portable telephone, his head is positioned close to the speaker 6 mounted to the surface of the PCB 1 opposite to the PCB surface to which the dipole antenna 2 is attached. In this case, the PCB 1, internally mounted in the portable telephone, serves as an electromagnetic shield plate, thereby reducing the intensity of near electromagnetic fields acting around the head. Accordingly, it is possible to achieve a reduction in SAR due to the shielding effect of the PCB.

However, the above mentioned antenna system of FIGS. 2*a* and 2*b*, which uses the dipole antenna 2 as an internal antenna and relies on the PCB 1 as a shield plate, has the following problems:

First, the power feeding circuit 3 requires a power feeding line in order to feed power to the dipole antenna 2. For this reason, the manufacturing costs of the portable telephone are increased.

Second, where the power feeding line is used, it is necessary to mechanically and electrically connect the dipole antenna 2 to the PCB 1. For this reason, the manufacturing time required to assemble the elements of the portable telephone is increased. This also results in an increase in the manufacturing costs of the portable telephone.

Third, a coupling mechanism having a contact pin structure provided with electrical contacts may be used to simplify the assembling process of the portable telephone. However, the reliability of this coupling mechanism tends to degrade because it is always in its electrically turned on state.

SUMMARY OF THE INVENTION

Therefore, an object of the present invention is to provide an antenna device in a radio communication terminal, which is capable of feeding power to an internal dipole antenna while using a PCB of the terminal as a shield plate.

Another object of the invention is to provide an antenna device in a radio communication terminal which is capable of achieving a reduction in SAR in case by using a non-protruding dipole antenna and a PCB of the terminal as a shield plate.

In accordance with the present invention, these objects are accomplished by providing an antenna device in a radio communication terminal adapted to transmit and receive radio signals comprising: a primary radiation element arranged on a first surface of a printed circuit board included in the terminal; a power feeding circuit for feeding transmission power to the primary radiation element; and a dipole antenna arranged to face the primary radiation element while being spaced apart from the primary radiation element to define a capacitance and magnetic coupling space. The primary radiation element on the first surface may be arranged opposite to a second surface of the printed circuit board to which a speaker included in the terminal is mounted. The dipole antenna facing the primary radiation element may be mounted to an inner surface of a case included in the terminal. The inner surface of the case is positioned to face the primary radiation element. Preferably, the printed circuit board and primary radiation element have a high dielectric constant.

BRIEF DESCRIPTION OF THE DRAWINGS

The above and other objects and advantages of the present invention will become more apparent from the following detailed description of the preferred embodiments, with reference to the attached drawings in which.

DETAILED DESCRIPTION OF THE PREFERRED EMBODIMENT

Figure 1:
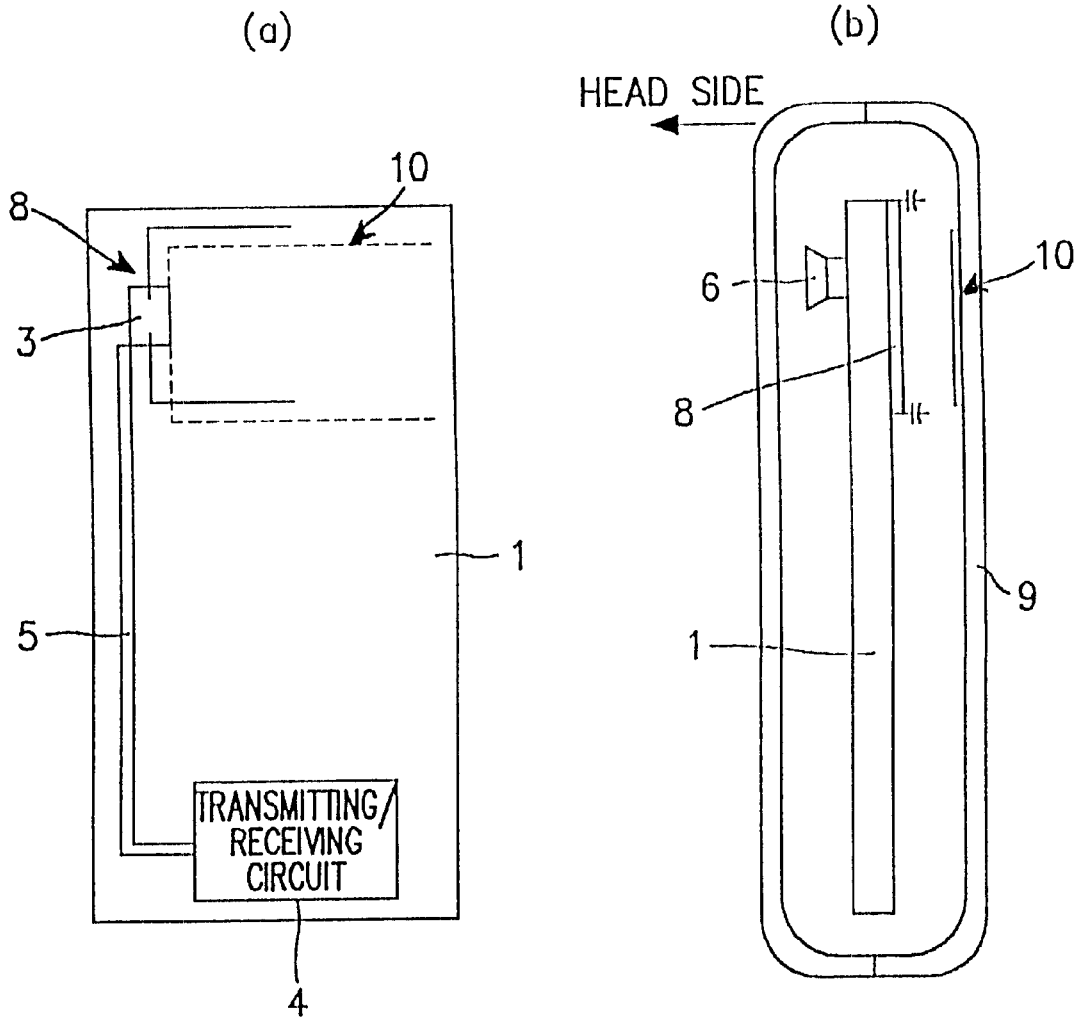
FIGS. 1*a* and 1*b* are front and side schematic views, respectively, illustrating an antenna device in a portable telephone according to a preferred embodiment of the present invention.

Now, preferred embodiments of the present invention will be described in detail, with reference to the accompanying drawings, in which like reference numerals identify similar or identical elements throughout the several views.

FIGS. 1*a* and 1*b* are schematic views illustrating an antenna device in a portable telephone according to a preferred embodiment of the present invention. FIG. 1*a* is a front view, and FIG. 1*b* is a side view. The structure and function of the antenna device according to the present invention will now be described in conjunction with FIGS. 1*a* and 1*b*.

In FIGS. 1*a* and 1*b,* reference numeral 1 denotes a PCB mounted in a phone body, and reference numeral 3 denotes a power feeding circuit comprising a micro strip circuit having a balun (not shown in FIGS. 1*a* and 1*b*). The power feeding circuit 3 is arranged at an upper portion of the PCB 1. Reference numeral 8 denotes a primary radiation element connected to the power feeding circuit 3 and formed on the PCB 1 to have a desired pattern. Also, reference numeral 4 denotes a transmitting/receiving circuit arranged at a lower portion of the PCB 1, and reference numeral 5 denotes a coaxial cable for connecting the transmitting/receiving circuit 4 and the primary radiation element 8 together. Reference numeral 6 denotes a speaker attached to a surface of the PCB 1 opposite to the PCB surface to which the primary radiation element 8 is mounted. That is, when the user uses the portable telephone, the speaker 6 faces the head of the user, while primary radiation element 8 is shielded from the user's head by PCB 1. Reference numeral 9 denotes a case of the portable telephone, and reference numeral 10 denotes a dipole antenna. The dipole antenna 10 is attached to the inner surface of the case 9 in such a fashion that it faces the primary radiation element 8 while being spaced apart from the primary radiation element 8. The dipole antenna 10 is formed in a pattern on the case 9. The pattern of the dipole antenna 10 may be formed on the inner surface, outer surface, or on a recessed portion of the case 9.

Now, the operation of the antenna device having the above mentioned configuration will be described.

Power from the transmitting/receiving circuit 4 is supplied to the micro strip circuit of the power feeding circuit 3 via the coaxial cable 5. The supplied power is then fed to the primary radiation element 8 after being unbalance/balance-transformed in terms of its transmission mode by a balun included in the power feeding circuit 3. The primary radiation element 8 serves as a primary antenna, and comprises a dipole type resonance circuit having two open terminals each resonating at a high voltage level at a certain frequency.

The dipole antenna 10 has a $\frac{1}{2}\cdot\lambda$ open terminal arranged above the primary radiation element 8 while being spaced apart from the primary radiation element 8. The $\frac{1}{2}\cdot\lambda$ open terminal is capacitance-coupled with the primary antenna of the primary radiation element 8. The radiation element of the dipole antenna 10 resonates, thereby causing electromagnetic waves to radiate into the space defined between the primary radiation element 8 and the dipole antenna 10.

As mentioned above, the user uses the portable telephone under the condition in which his head is positioned close to the speaker 6 attached to the surface of the PCB 1 opposite to the PCB surface to which the primary radiation element 8 is mounted, and opposite to the location of dipole antenna 10 mounted on case 9. Accordingly, the PCB 1 serves as a shield plate for shielding electromagnetic waves. As a result, the intensity of electromagnetic waves acting around the head is reduced. Thus, a reduction in SAR is achieved.

Figure 2:
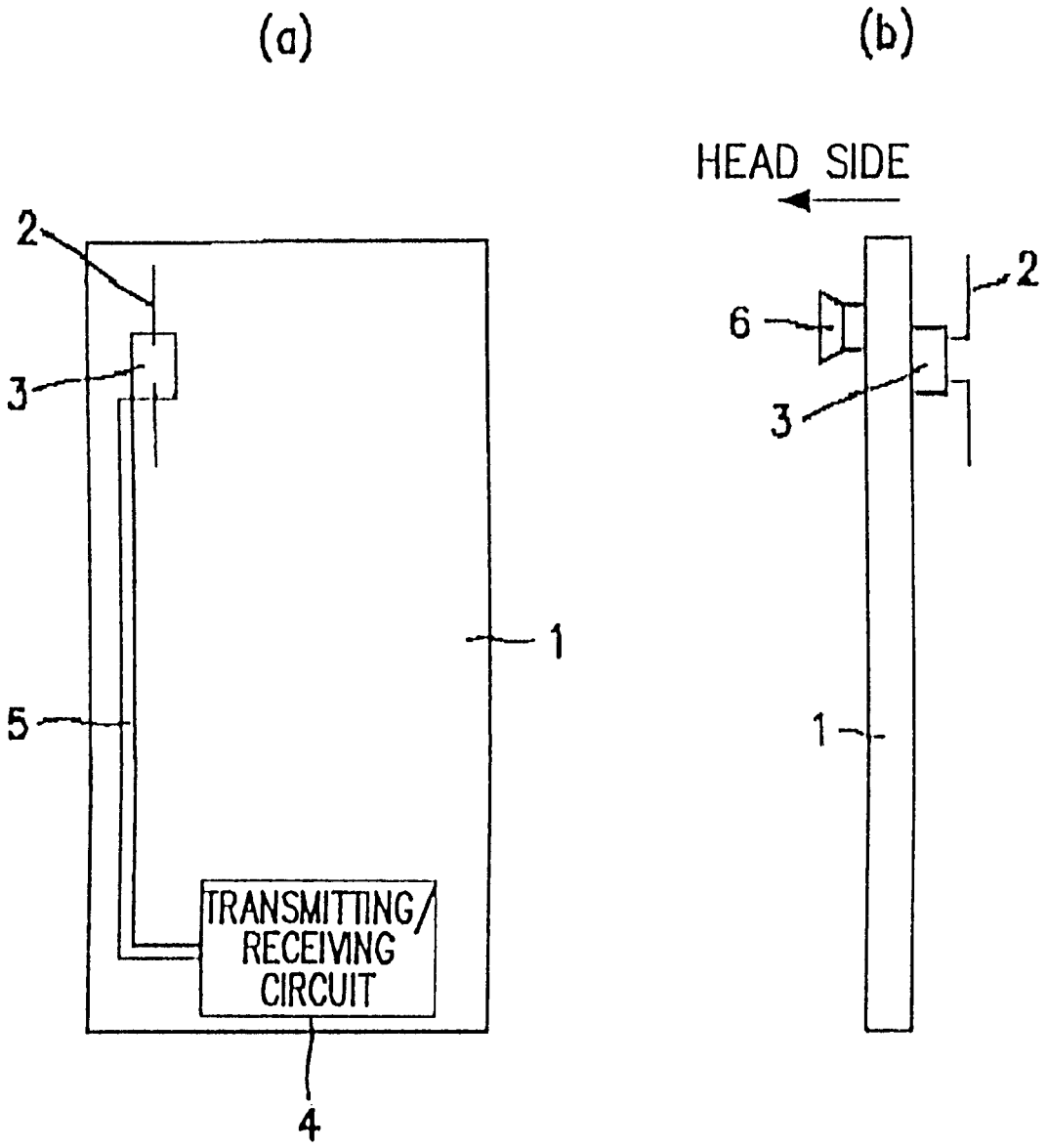
FIG. 2 (PRIOR ART)
FIGS. 2*a* and 2*b* are front and side schematic views, respectively, illustrating a conventional antenna device in a portable telephone in which a PCB serves as a shield plate.

Although the primary radiation element 8 and the dipole antenna 10 are mechanically spaced apart from each other, they are capacitance-coupled or magnetically coupled together. Accordingly, it is unnecessary to mechanically and electrically couple the power feeding circuit 3 and the dipole antenna 2 together, as compared to the conventional antenna assembly as shown in FIGS. 2*a* and 2*b*. Therefore, it is possible to dispense with the power feeding line to dipole antenna 10. Thus, it is possible to achieve an easy assembling process in the manufacture of the portable telephone while achieving an enhancement in reliability.

Since the primary radiation element 8 is formed on the PCB, the intensity of an electric field generated at the primary radiation element 8 is reduced due to the relative dielectric constant of the PCB. That is, the intensity of the electric field corresponds to about the inverse of the square root of the dielectric constant. Accordingly, it is possible for the primary radiation element 8 to have a reduced size by fabricating the PCB 1 using a material having a high relative dielectric constant. In this regard, the primary radiation element 8 may be modularly fabricated using a ferroelectric ceramic having a high dielectric constant (approximately 30 or more).

Although dipole antennas using a ferroelectric ceramic may have a reduced size, it is difficult to use them as radiation antennas because they exhibit a very low radiation resistance. In the antenna structure of the present invention, however, it is possible to use a ferroelectric ceramic for the primary radiation element for feeding power to the radiation antenna (that is, the dipole antenna 10) spaced apart from the primary radiation element. This is because the radiation resistance is determined by the size of the radiation element.

Although the present invention has been described in conjunction with portable telephones, it may be applied to other portable communication terminals such as PHSs or PDAs.

As is apparent from the above description, in accordance with the present invention, the speaker is arranged on the surface of the PCB opposite to the PCB surface to which the primary radiation element is mounted. Since the PCB serves as a shield plate against electromagnetic fields radiated from the antenna, thereby reducing the intensity of electromagnetic fields acting around the PCB surface on which the speaker is arranged, it is possible to reduce the intensity of electromagnetic fields acting around the head of the user positioned close to the speaker. Thus, an advantage of the present invention is that a reduction in SAR is achieved.

In accordance with the present invention, the primary radiation element, to which transmission power is fed, is mounted to the PCB. Also, the dipole antenna is arranged at a position spaced apart from the primary radiation element. Accordingly, it is possible to dispense with the power feeding line. Thus, it is possible to achieve an easy assembling process in the manufacture of the portable telephone while reducing the manufacturing costs.

While this invention has been described in connection with what is presently considered to be the most practical and preferred embodiment, it is to be understood that the invention is not limited to the disclosed embodiment, but, on the contrary, it is intended to cover various modifications within the spirit and scope of the appended claims.

What is claimed is:

1. An antenna device in a radio communication terminal adapted to transmit and receive radio signals comprising:

a primary radiation element arranged on a first surface of a printed circuit board included in the terminal;

a power feeding circuit for feeding transmission power to the primary radiation element; and a dipole antenna arranged adjacent to the primary radiation element while being spaced apart from the primary radiation element to define a space there between, wherein the primary radiation element and the dipole antenna are magnetically and capacitively coupled across said space.

2. The antenna device according to claim 1, wherein the primary radiation element on the first surface is arranged opposite to a second surface of the printed circuit board to which a speaker included in the terminal is mounted.

3. The antenna device according to claim 1, wherein the dipole antenna faces the primary radiation element and is mounted to an inner surface of a case of the terminal, the inner surface facing the primary radiation element.

4. The antenna device according to claim 3, wherein the printed circuit board has a high dielectric constant.

5. The antenna device according to claim 4, wherein the primary radiation element has a high dielectric constant.

6. The antenna device according to claim 2, wherein the printed circuit board has a high dielectric constant.

* * * * *